US006546671B2

(12) United States Patent
Mitchell et al.

(10) Patent No.: US 6,546,671 B2
(45) Date of Patent: Apr. 15, 2003

(54) TILT WINDOW LATCH ASSEMBLY

(75) Inventors: Michael Mitchell, Rib Lake, WI (US); Kevin Schield, Medford, WI (US)

(73) Assignee: Weather Shield Mfg., Inc., Medford, WI (US)

( * ) Notice: Subject to any disclaimer, the term of this patent is extended or adjusted under 35 U.S.C. 154(b) by 0 days.

(21) Appl. No.: 09/921,200

(22) Filed: Aug. 1, 2001

(65) Prior Publication Data

US 2003/0024168 A1 Feb. 6, 2003

(51) Int. Cl.[7] ..... E05D 15/22

(52) U.S. Cl. ..... 49/185; 292/DIG. 20; 292/DIG. 47; 49/183

(58) Field of Search ..... 49/183, 184, 185, 49/186, 449; 292/6, 67, 203, DIG. 20, DIG. 35, DIG. 47, 172, 175

(56) References Cited

U.S. PATENT DOCUMENTS

| | | | | |
|---|---|---|---|---|
| 1,573,662 A | | 2/1926 | Warga | |
| 3,811,718 A | | 5/1974 | Bates | |
| 4,475,311 A | | 10/1984 | Gibson | |
| 4,525,952 A | * | 7/1985 | Cunningham et al. | 49/449 |
| 5,090,750 A | * | 2/1992 | Lindqvist | 292/DIG. 20 |
| 5,110,165 A | | 5/1992 | Piltingsrud | |
| 5,398,447 A | | 3/1995 | Morse | |
| 5,653,485 A | | 8/1997 | Campbell | |
| 5,715,631 A | | 2/1998 | Kailian et al. | |
| 5,791,700 A | | 8/1998 | Biro | |
| 5,992,907 A | | 11/1999 | Sheldon et al. | |
| 6,076,304 A | | 6/2000 | Carrier | |
| 6,155,615 A | | 12/2000 | Schultz | |
| 6,349,576 B2 | * | 2/2002 | Subliskey | 292/DIG. 20 |

* cited by examiner

*Primary Examiner*—Jerry Redman
(74) *Attorney, Agent, or Firm*—Price, Heneveld, Cooper, DeWitt & Litton

(57) ABSTRACT

A latch assembly for double hung windows also permits each of the sashes to be tilted inwardly with respect to the window frame assembly. The window latch assembly includes a keeper which is recessed within a lower rail of the upper window sash, and a latch which is recessed in the upper rail of the lower window sash and positioned such that the latch and the keeper are selectively engaged upon rotation of a sweeper cam. The sweeper cam also engages a slide translatable between a first position engaging one of the side rails of the window frame assembly, and a second position, retracted within the lower window sash and release the upper edge of the window sash from the window frame assembly.

18 Claims, 11 Drawing Sheets

TILT WINDOW LATCH ASSEMBLY

BACKGROUND OF THE INVENTION

1. Field of the Invention

This invention relates to window latches for double hung windows, and particularly to a latch assembly for use on double hung windows wherein the lower window sash is able to tilt inwardly with respect to the window frame.

2. Discussion of the Related Art

Window latches for double hung windows are well known. Typically, a latch housing is attached to an upper rail of a window sash wherein the latch housing contains a sweeper cam moved by a handle in and out of a keeper attached to a lower rail of the adjacent window sash. Patents illustrating such arrangements include U.S. Pat. Nos. 5,715,631; 5,161,839; and 4,095,829. It is also known to mount the window sashes in a double hung window such that each sash tilts in and out of engagement with the window frame for the purposes of providing easy access to the window exterior for cleaning and the like. Typically, special latches are attached to the corners of each window sash such that the latches engage slots formed in the interior of the window frame. See in particular U.S. Pat. Nos. 6,155,615 and 4,475,311. In another arrangement, the latches are configured to engage a slide track in the window frame to permit tilting of the window. Examples illustrating complicated arrangements include U.S. Pat. Nos. 5,992,907; 5,791,700; and 4,398,447.

Disadvantages of the prior latching arrangements include insecure fastening of the two window sashes via the sweeper cam systems, difficult manipulation, a need to overcome spring tensions to withdraw the window latches from the window tracks, and complicated geared slides which are expensive to manufacture. Moreover, many of the latching mechanisms require additional modifications to the stiles and rails of the window sashes. Accordingly, it is an object of the instant invention to provide an inexpensive, yet easy to operate latch assembly for double hung windows which provide secure locking of the two window sashes, yet which are easily released to open the window, and permit the window sash to tilt inwardly.

SUMMARY OF THE INVENTION

A window assembly, comprising of a window frame having two opposing side rails, a top rail, and a bottom rail. Disposed in a sliding engagement in the window frame is an upper and a lower sash frame, each configured to translate parallel to the two opposing side rails and between the top and bottom rails. Attached to the upper sash is at least one keeper while a latch assembly is attached to an upper edge of a lower sash. The latch assembly includes a slide urged towards one of the two opposing side rails of the window frame, and has an intermediate opening receiving an eccentric sweeper cam pivotally mounted in the upper rail of the lower sash. The sweeper cam includes a portion adapted to engage at least one keeper in the lower rail of the upper sash frame, and further includes an edge adapted to engage the slide and move the slide between an extended and retracted position. A lever is located on the upper edge of the lower sash and is attached to the eccentric sweeper cam for rotating the eccentric sweeper cam between a first and second position such that the eccentric sweeper cams engages the slide in the intermediate opening to move the slide between a first and second position.

In another form of the invention, a window locking assembly is provided which includes a window frame, and an upper window sash movable within the frame. A keeper is disposed in a lower rail of the upper window sash. A lower window sash is also disposed within the window frame and moveable within the window frame. The lower window sash has a latch assembly disposed in an upper rail and is adapted to engage the keeper disposed in the lower rail of the upper window sash. The latch assembly includes a slide configured to translate between a first position engaging the window frame, and a second position retracted within the lower window sash. The slide is translated by a sweeper cam pivotally coupled to the latch assembly and journaled in the upper rail of the lower window sash such that upon rotation of the sweeper cam, the slide is translated between the first and second positions. The sweeper cam is rotated by a lever attached at one end and positioned on the upper surface of the upper rail of the lower window sash.

In yet another embodiment of the invention, an assembly for locking the relative positions of a first window sash relative to a second window sash is provided. Both sashes are in sliding engagement with the window frame. The assembly includes a keeper recessed within a lower rail of a first window sash, and a latch assembly disposed within an upper rail of a lower window sash such that the keeper and the latch assembly are adjacent each other when the first window sash and a second window sash close the window frame. The latch assembly includes a housing recessed in the upper rail of the lower window sash and contains a slide translatable within the housing between a first extended position engaging the window frame, and a retracted position within the lower window sash. The slide is translated by a sweeper cam pivotally coupled within the housing. A lever attached to the upper end of the sweeper cam is disposed at the upper surface of the upper rail of the second window sash to rotate the sweeper cam between the first and second position.

The instant invention provides a unique window assembly which comprises a window frame having two opposing side rails, a top rail, and a lower rail and an upper window sash assembly slidably disposed between the two opposing side rails. A keeper is disposed within a recess formed in the inside surface of the lower member of the upper window sash assembly. A lower window sash assembly is also provided in sliding engagement between the two opposing side rails and offset from the upper window sash assembly. A latch assembly is disposed within a recess formed in the inside upper member of the lower window sash assembly, and is adapted to engage the keeper in the upper window sash assembly, and selectively with one of the two opposing side rails of the window frame assembly. The latch assembly includes a slide which translates within the latch assembly between a first extended position, engaging the window frame, and a second retracted position within the latch assembly. The slide is translatable by a sweeper cam rotatably mounted within the latch assembly housing and includes an upper end which extends through the lower window sash assembly when a handle is fixably mounted thereto. Moreover, the sweeper cam includes a portion which is adapted to engage in locking arrangement, the keeper disposed in the upper window sash assembly.

The advantages offered by the different forms of the invention include a less complicated, less costly latching mechanism for fixing the relative position of double hung windows while simultaneously providing the ability for the double hung windows to be tilted inwardly from the window frame to enable the user to service the window exterior from the inside of the house. Moreover, the instant invention provides a much more clean and ecstatically pleasing latch assembly than previously provided in that the latch assembly and keeper are concealed within the upper and lower rail members of the respective window sashes.

These and other objects, advantages, purposes, and features of the invention will become more apparent from a study of the following description taken in conjunction with the drawing figures described below.

BRIEF DESCRIPTION OF THE DRAWING FIGURES

DETAILED DESCRIPTION OF THE PREFERRED EMBODIMENT OF THE INVENTION

Figure 1:
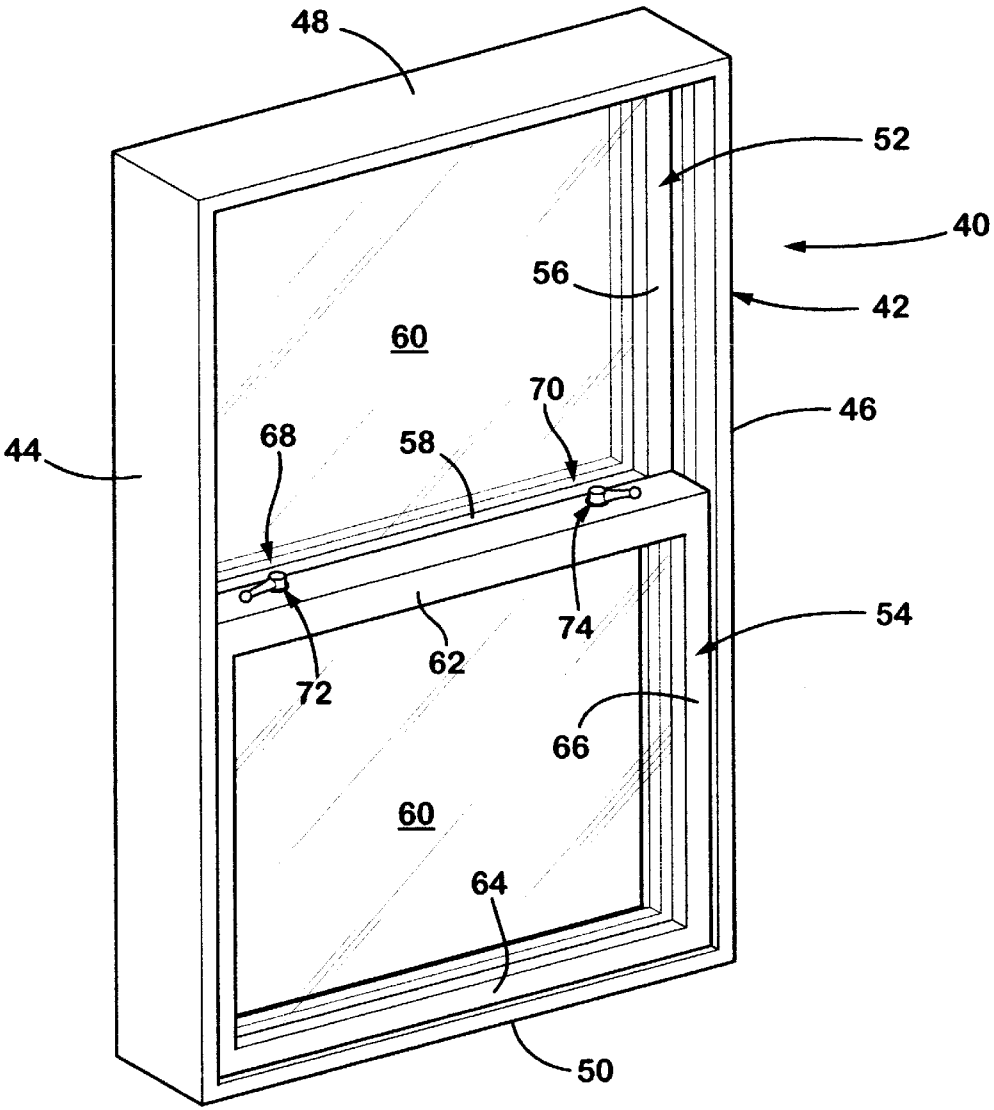
FIG. 1 is a perspective view of a double hung window including a pair of window latch assemblies in accordance with a preferred embodiment of the invention.

For purposes of the following description, the terms "upper," "lower," "left," "rear," "front," "vertical," "horizontal" and derivatives of such terms shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts. Specific dimensions and other physical characteristics relating to the embodiments disclosed herein are not to be considered as limiting, unless expressly stated otherwise.

Figure 2B:
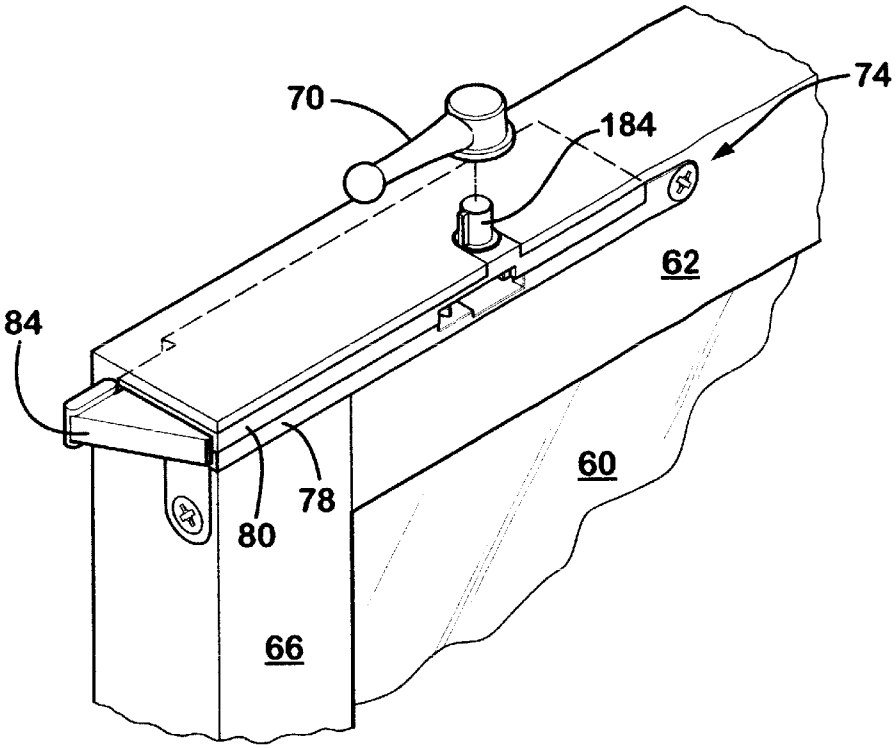
FIG. 2B is a fragmentary perspective view of an opposite side of the lower window sash.

FIGS. 1 through 2B illustrates a window assembly 40 comprising a window frame 42 having two opposing stiles 44 and 46, a top rail 48, and a bottom rail 50. Disposed in sliding relationship within the window frame 42 is an upper window sash frame 52 and a lower window sash frame 54. Both the upper and the lower window sash frames 52 and 54 are adapted to slide parallel to the two opposing stiles 44 and 46 in between the top and bottom rails 48 and 50, respectively. The upper window sash frame 52 includes an upper rail (not shown), opposing mirror image stiles 56 and a bottom rail 58 interconnected together to provide a rectangular frame for the window pane assembly 60. The lower window sash frame 54 also includes a top rail 62, a bottom rail 64, and stiles 66. In the embodiment, the upper window sash frame 52 includes at least one, and preferably two keepers 68 and 70 attached to the bottom rail 58 proximate the ends attached to stiles 56. The top rail 62 of the lower window sash frame 54, also referred to as the locking rail, includes a corresponding pair of window latches 72, 74 attached thereto which are intended to engage the respective keepers 68, 70 and lock the respective window sashes in position. The window latches 72, 74, shown in FIG. 1, are mirror images of each other and are positioned near the comers of the window sash frames 54 and 56 nearest the left frame stile 44 and the right side stile 46, respectively.

The remaining drawing figures illustrate the elements of the right window latch 74 and the associated keeper 70 in accordance with one embodiment of the instant invention shown in FIGS. 1 through 2B. It is understood that the left window latch 72 and keeper 68 shown in FIG. 1 includes all of the elements as shown in the right window latch 74, but as a mirror image of what is shown and described below.

Figure 5:
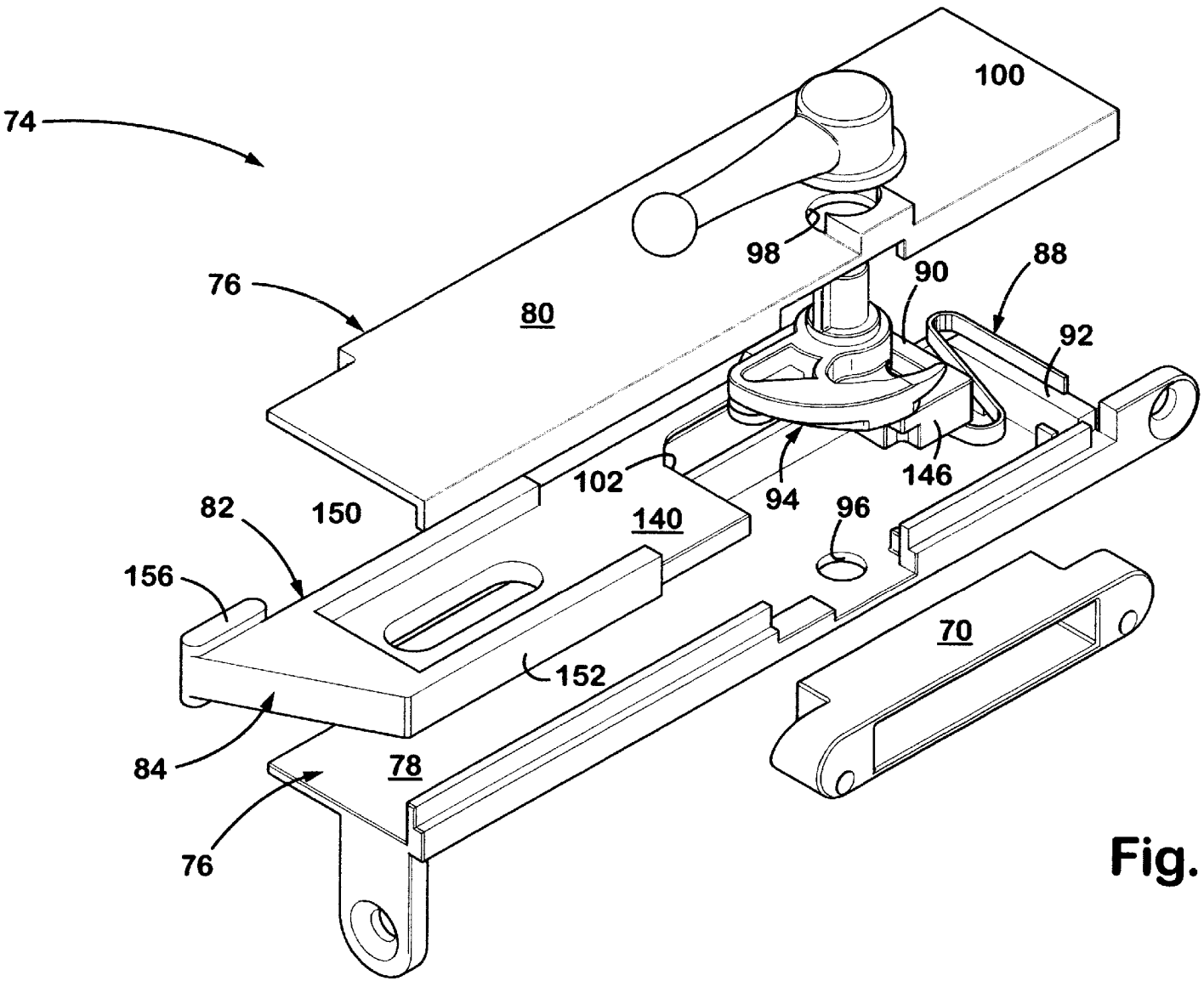
FIG. 5 is an exploded oblique view of the embodiment of the tilt latch assembly shown in FIG. 3.
Figure 6:
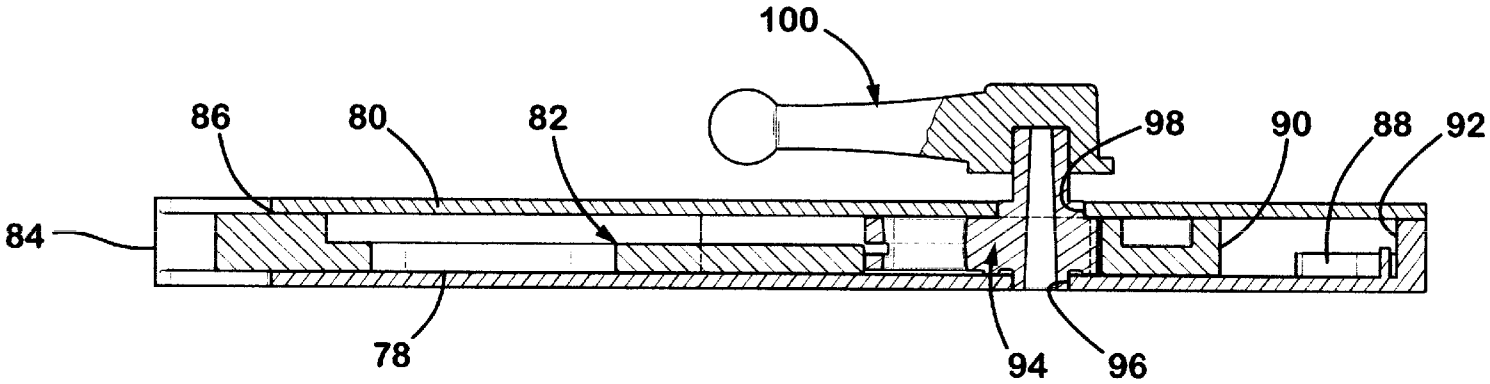
FIG. 6 is a section view of the tilt latch assembly shown in FIG. 3 and taken along line F—F.
Figure 7:
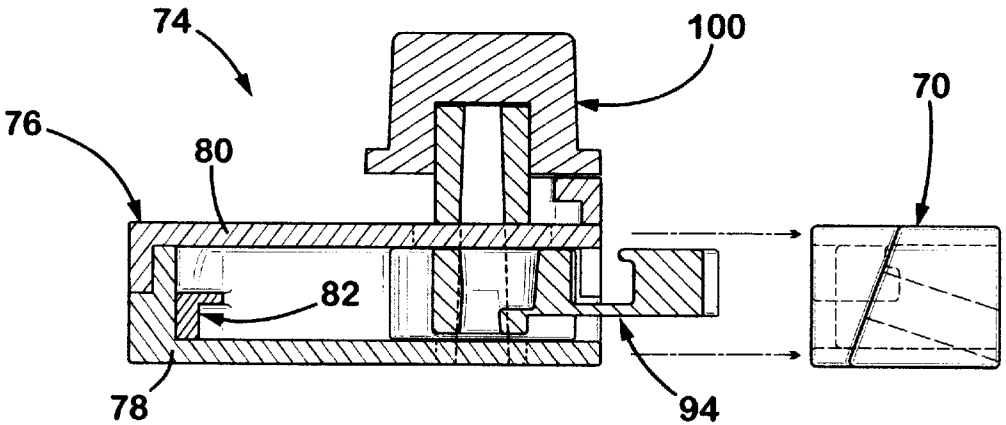
FIG. 7 is a section view of the tilt latch assembly shown in FIG. 4 and taken along line E—E.

Referring to FIGS. 3 through 7, the right window latch 74 includes a housing 76 formed by a lower housing portion 78 adapted to receive and mate with an upper housing portion 80. Disposed in the interior of the housing 76 is a slide 82 held entirely between the upper and lower housing portions, 78, 80. The slide 82 has a width (w) and height (h) configured to fit within the respective corresponding dimensions of the housing 76, yet has a length (l) which is slightly shorter for reasons which will become apparent below. See FIG. 5. The length (l) of the slide member 82 is slightly shorter than that of the interior of the housing 76 such that the slide member 82 can translate within the housing 76 between a first position within the housing 76, and a second position such that end 84 of slide 82 extends from one end 86 of the housing 76. To urge the slide 82 from the housing 76, a spring or other biasing member 88 is positioned within the housing 76 between end 90 of slide 82 and the interior end 92 of housing. Keeping the slide 82 within the housing 76 is a sweeper cam, generally identified by reference numeral 94, a lower end of which is journaled within bearing hole 96 formed in the lower portion of the housing 78. An opposite end of the sweeper cam 94 extends up through a bearing hole 98 formed on the upper housing portion 80, where it is attached to a lever or crank 100. As best illustrated in FIG. 5, the sweeper cam 94 is disposed between the upper and lower housing portions 78, 80 and within a generally rectangular opening 102 defined within the body 140 of the slide member 82. In this fashion, the sweeper cam 94 serves to retain the slide 82 within the housing 76. As can be seen in FIG. 5, the sweeper cam 94 is not directly coupled to the slide 82, but rather is trapped within the three sides of the opening 102 such than a perimeter of the sweeper cam 94 comes into contact with the slide 82 when the sweeper cam 94 is rotated.

Figure 8:
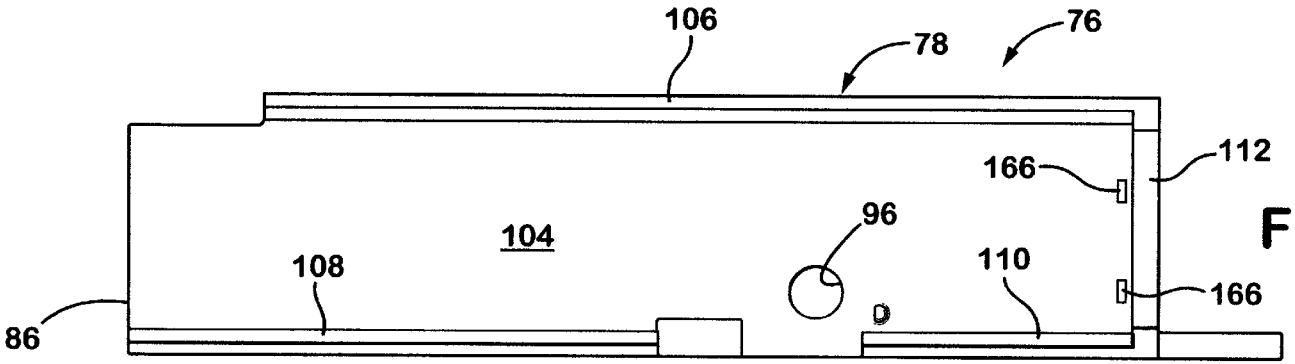
FIG. 8 is a plan view of the lower tilt latch assembly housing.
Figure 9:
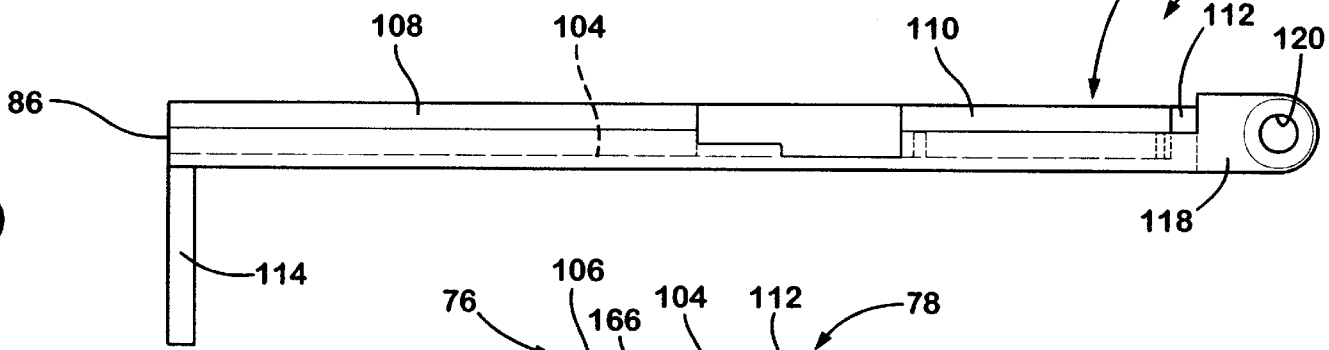
FIG. 9 is an elevation view of the lower tilt latch assembly housing.
Figure 10:
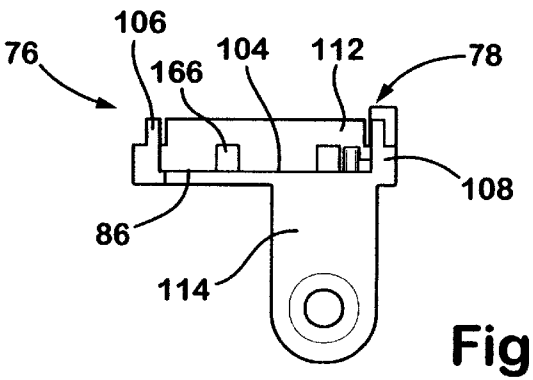
FIG. 10 is an end view of the lower tilt latch assembly housing.

FIGS. 8 through 10 illustrate one embodiment of the lower housing portion 78. The lower housing portion 78 includes a bottom plate 104 having upwardly extending side walls 106, 108, 110, and an end wall 112. The end 86 of the housing 76 and an end portion of side wall 106 is open for reasons which will become readily apparent below. In addition, an opening exists between side wall portions 108 and 110 for purposes of permitting the sweeper cam 94 to pass there through.

Integral with the bottom plate 104 and extending downwardly therefrom is a flange 114 having an opening 116 extending there through for receiving a fastener used to attach the lower housing portion 78 to the top rail 62 of the lower window sash frame 54. An additional flange 118 is provided at the opposite end of the housing which contains an opening 120 for attaching the opposite end of the lower housing portion 78 to the lower window sash frame 54.

Figure 11:
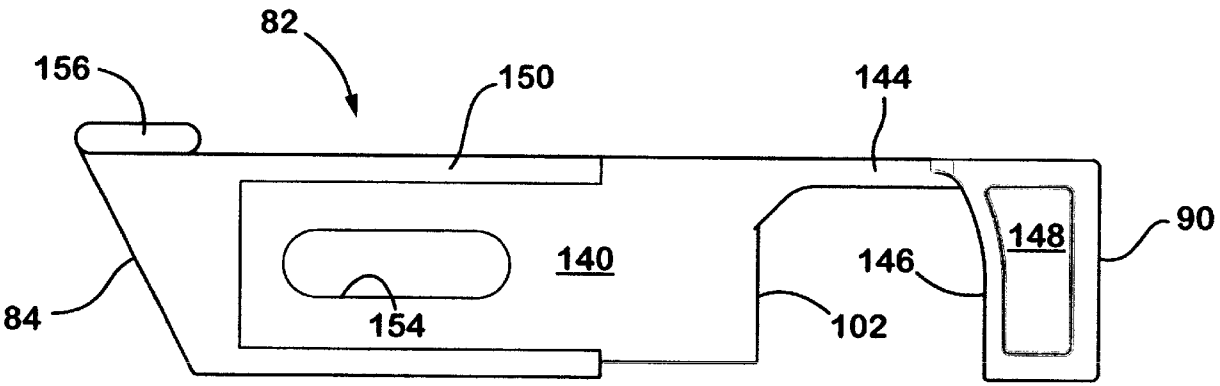
FIG. 11 is a plan view of the tilt latch assembly slide.
Figure 12:
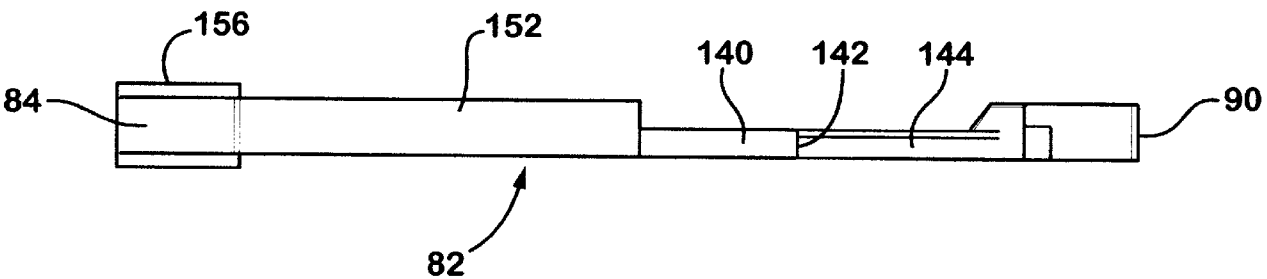
FIG. 12 is an elevation view of the tilt latch assembly slide.
Figure 13:
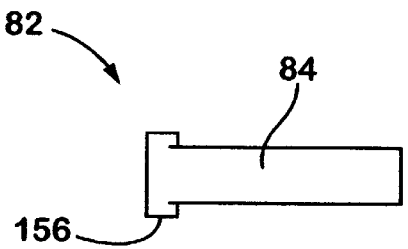
FIG. 13 is an end view of the tilt latch assembly slide.

FIGS. 11 through 13 provide various views of the tilt latch assembly slide 82. As briefly mentioned above, the slide 82 includes an angular first end 84, and a generally rectangular opposite end 90. The respective ends 84, 90 are interconnected by a web 140 having a generally rectangular opening 102 proximate end 90 wherein a substantially rigid strap 144 extends between end 90 and the web 140. Intermediate end 90 and strap 144, a generally rectangular wall 146 having a thickness substantially greater than web 140 surrounds a central web 148 for increasing stiffness and preventing rotation within the housing 76. Toward end 84 of the slide, the web 140 also includes thickened side walls 150, 152, substantially similar in thickness to that of wall 146. It should be noted that the height of walls 146, 150, 152, and the thickness of end 84 of the slide are just slightly less than the internal opening or cavity of the housing 76 briefly described above. The thickened walls proximate end of slide 90 and end of slide 84 act as spacers place only a limited upper surface of the slide 82 in contact with the upper housing portion 80, thereby reducing friction. Structural stiffening of the slide is enhanced by an oval cutout 154.

Positioned along the exterior of wall 150, near the tip of end 84 of the slide 82 is a tab 156, the exterior surface of which is configured to engage a channel in the window frame 42. As best illustrated in FIG. 12, the height of the tab 156 is slightly greater than the thickness of the walls 150, 152, and end of slide 84, but in no event is it preferred to be greater than the total thickness of the housing 76. As mentioned above with respect to FIG. 3, accommodations are made in the exterior of the housing 76 to permit tab 156 ample room to translate as well in the top rail of the sash. In combination, the thickened walls 146, 150, 152 cooperate with the interior of the housing 76 to make the slide 82 substantially more rigid.

Figure 14:
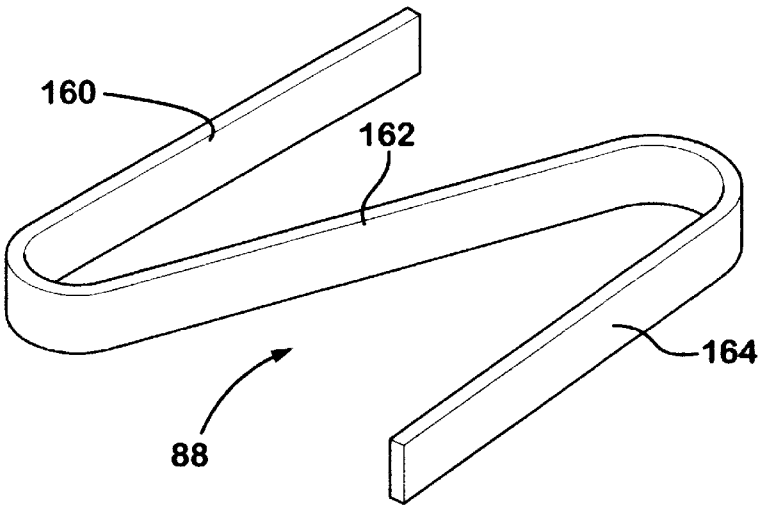
FIG. 14 is an oblique view of the tilt latch assembly return spring.

FIG. 14 best illustrates the spring 88 contemplated to be used in a preferred embodiment of the invention. As illustrated in the drawing figure, it is preferred that spring 88 to be a leaf spring including an end leg 160, an intermediate leg 162, and an opposite end leg 164, the various legs arranged in the form of an angular S-shape. It is intended to place spring 88 in the lower housing portion 78 between end 90 of the slide 82 and the interior of end wall 112 such that leg 160 or 164 is disposed between tabs 166 extending up from the bottom plate 104 and end wall 112 (See FIG. 8). The opposite end of leg 160 or 164 is configured so that the length of the leg engages the end 90 of slide 82. The distance between end 90 of slide 82 and the inside of end wall 112 is such that spring 88 urges slide 82 out the end 86 of the housing 76 sufficiently such that tab 156 engages the interior of the window frame 42 to retain the window therein.

Figure 18:
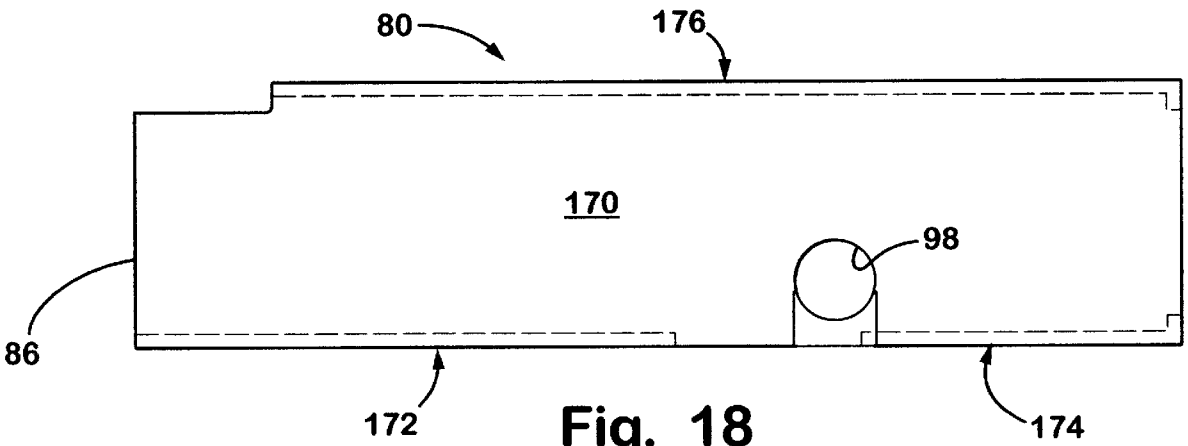
FIG. 18 is a plan view of the tilt latch assembly top housing.
Figure 19:
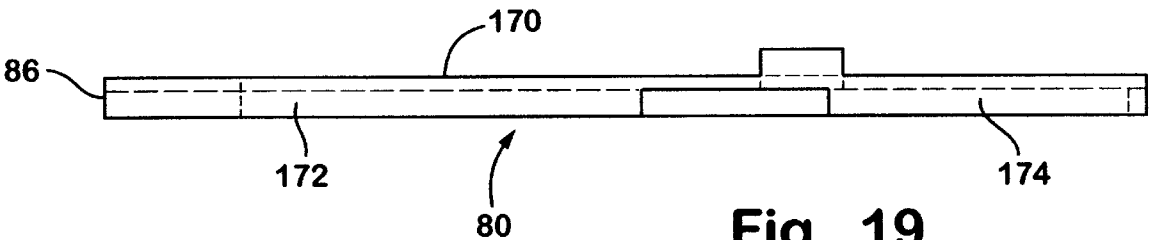
FIG. 19 is an elevation view of the tilt latch assembly top housing.
Figure 20:
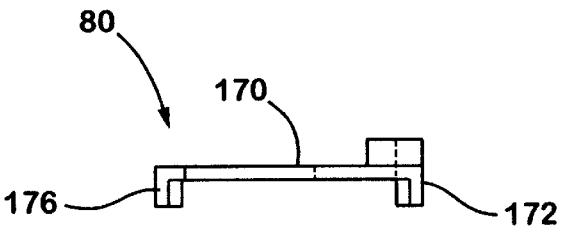
FIG. 20 is one end view of the tilt latch assembly top housing.
Figure 21:
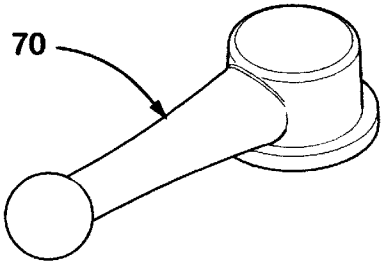
FIG. 21 is an oblique view of the tilt latch assembly handle.

FIGS. 18 through 20 illustrate the upper housing portion 80 which enclosed the slide member 82, a substantial portion of the sweeper cam 94 and the spring 88 therein. The upper housing portion 80 is configured to mate with and close the lower housing portion 78 and includes a top plate 170 having a length substantially greater than its width and height and includes downwardly depending flanges or walls 172, 174, and 176 adapted to mate with walls 108, 110, and 106, respectively. Just as with wall 106 in the lower housing portion 78, wall 176 does not extend entirely toward end 86 for the purposes of providing sufficient space for the tab 156 to translate between the extended and the retracted position. The upper journal hole 98 passes through the top plate 170, intermediate walls 172, 174 for purposes of journaling the upper end of the sweeper cam 94 as briefly described earlier. Adjacent journal hole 98 proximate side wall 174, and extending up from top plate 170 is a shoulder 178 having a height which is intended to be flush with the upper surface of the top rail 62 of the lower sash as seen in FIG. 2. The purpose of shoulder 178 is simply to fill a gap which would otherwise exist in the upper surface of the top rail 62 after the latch was installed. The top or upper end 184 of the sweeper cam shaft 180 extending above the upper housing portion 80 receives a lever or crank arm 206 shown in greater detail in FIG. 21. As in the case of the lower housing portion 78, the upper portion 80 of the housing 76 may be manufactured from a wide range of materials, including a polymeric or metallic material. In the preferred embodiment, the upper portion 80 of the housing 76 is injection molded.

Figure 15:
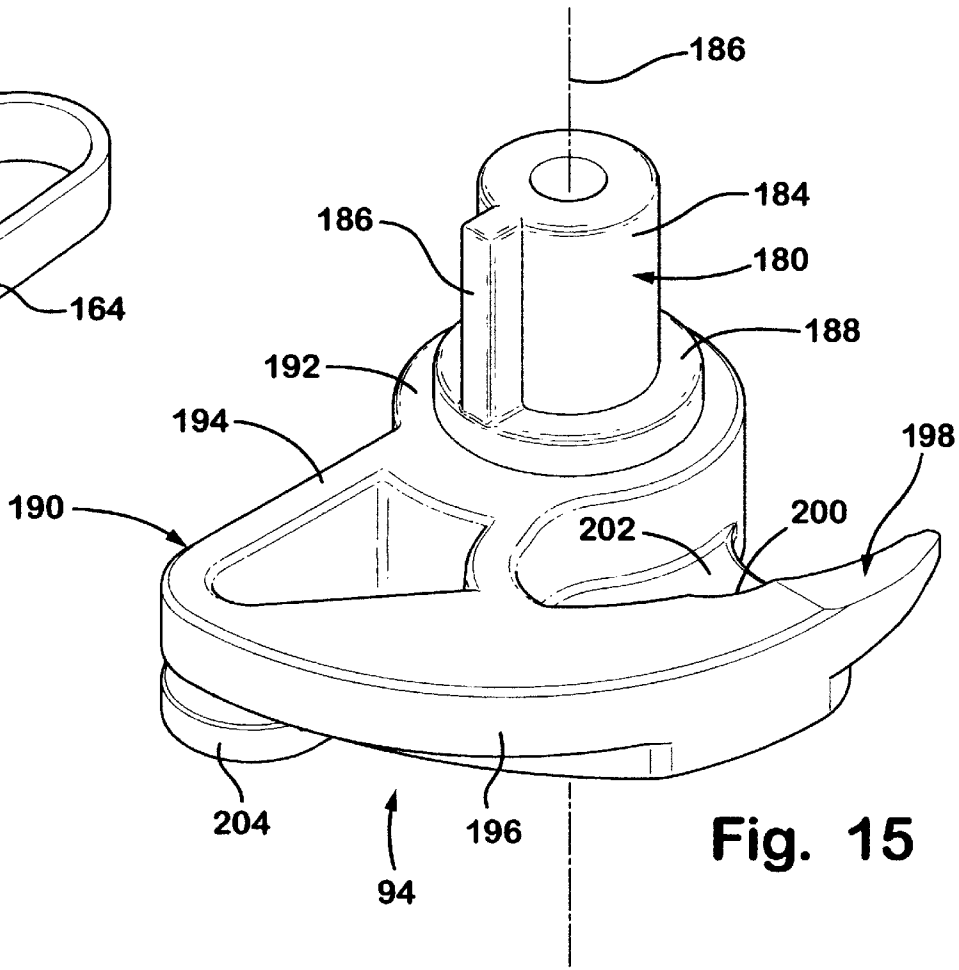
FIG. 15 is an oblique view of the sweeper cam.
Figure 17:
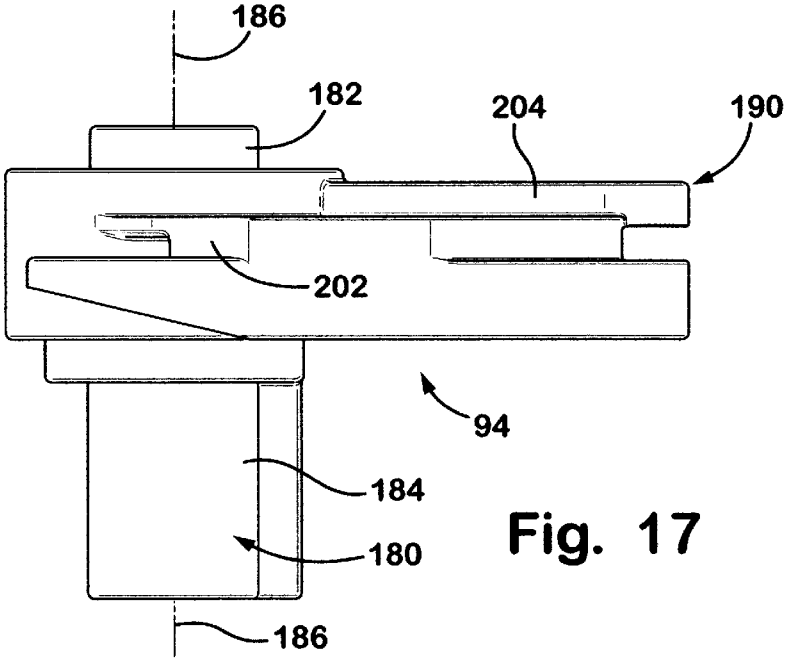
FIG. 17 is an elevation view of the sweeper cam.
Figure 16:
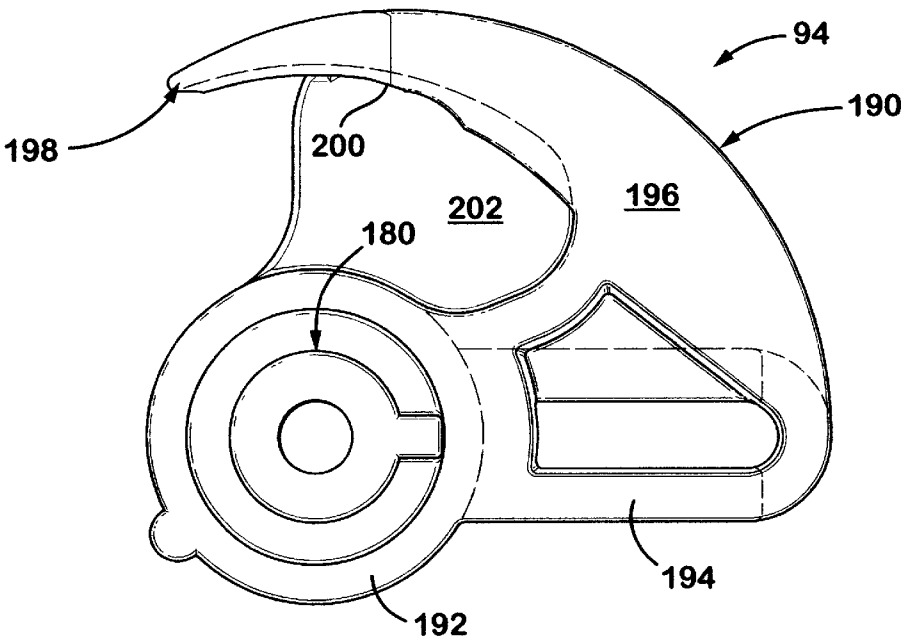
FIG. 16 is a plan view of the sweeper cam.

FIGS. 15 through 17 illustrate the sweeper cam 94 contemplated for the invention. In this embodiment, the sweeper cam 94 includes a shaft 180 wherein a lower end 182 is substantially shorter than the upper end 184. The shaft 180, generally in the form of a right circular cylinder, defines a rotation axis 185 for the cam. In the embodiment shown, the lower end 182 of shaft 180 is received within the lower journal hole 96 extending through the bottom plate 104 while the upper end 184 of shaft 180 extends through the upper journal hole 98 formed in the top plate 170. Extending vertically along the exterior of the upper end 184 of shaft 180 is a key 186, extending up from a collar 188 which is concentric with the axis 185 and shaft 180. In the preferred embodiment, the diameter of the lower shaft end 182 is such to be received just within the lower journal hole 96, while the diameter of the upper journal hole 98 is just slightly larger than the outside diameter of the collar 188. The larger diameter of the upper journal hole 98 is necessary in order to accommodate the key 186, as well as the shaft 180.

Extending from the shaft 180 is the cam 190 which is formed integrally with shaft 180. The cam 190 includes a central hub portion 192 from which arm 194 radiates. Extending in an eccentric arc from the end of arm 194 is the sweep arm 196 of the cam 190 which terminates in a tapered tip 198. In a preferred embodiment, the upper surface of the tip 198 and sweep arm 196 is inclined, rising from the end of the tip 198 toward the end of arm 194. Likewise, the interior edge 200 of the sweep arm 196 also extends in an eccentric arc starting from the point at the tip 198 and tapering inwardly toward the hub 192 in a clockwise direction as viewed in FIG. 16. To provide strength to the sweep arm 196, a web 202 extends from the lower portion of the hub 192 from a point proximate the lower end 182 of the shaft 180, to an outer portion of the sweep arm 196. Additionally, a second flange 204 extends from hub 192 substantially parallel and along the same radial axis as arm 194. The tip 198 and sweep arm 196 of the sweeper cam 94 is designed such that upon a rotation of the sweeper cam 94, the tip 198 swings into the opening 132.

Figure 22:
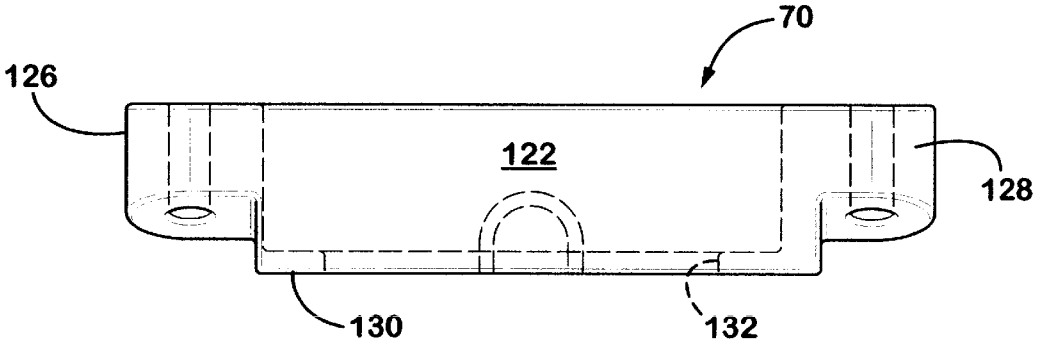
FIG. 22 is a plan view of the tilt latch assembly keeper.
Figure 23:
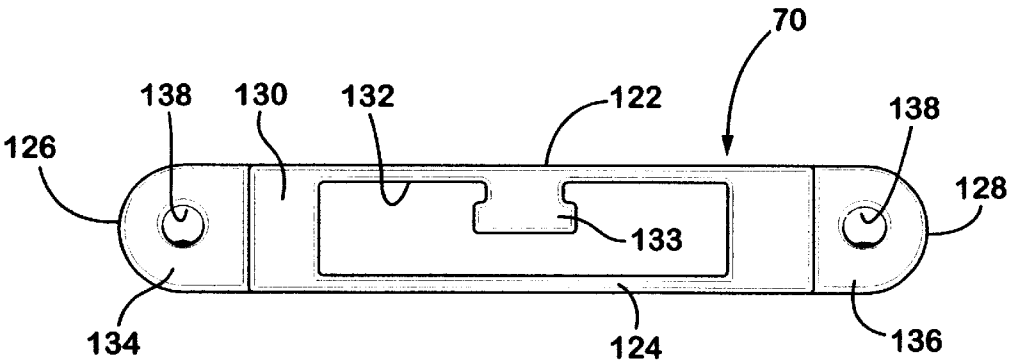
FIG. 23 is an elevation view of the tilt latch assembly keeper.
Figure 24:
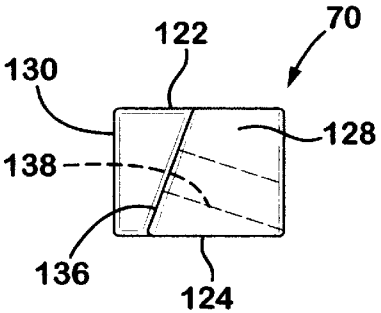
FIG. 24 is an end view of the tilt latch assembly keeper.

FIGS. 22 through 24 illustrate in different views the keeper 70 used in the preferred embodiment of the invention. Referring to the drawing figures, the keeper 70 is preferably formed from a polymeric material using an injection molding technique, or alternatively, from a metal using a conventional casting method. As illustrated, the keeper 70 is generally rectangular in plan form and elevation view having an upper wall 122, a lower wall 124 interconnected to the upper wall 122 by curved end walls 126, 128. Also interconnecting the upper wall 122 and the lower wall 124 is a side wall 130 having a generally rectangular opening 132 formed therein. Adjacent the side wall 130 and proximate the end walls 126, 128 are recessed faces 134, 136, each containing a hole 138 extending there through for receiving a fastener to attach the keeper 70 to the bottom rail 58 of the upper window sash frame 52. In this particular case, because the fasteners (not shown) are passing through the holes 138 in recessed faces 134, 136 generally horizontally, it is understood that the keeper 70 is received in a recessed formed in the wood of the bottom rail 58 of the sash.

Figure 2A:
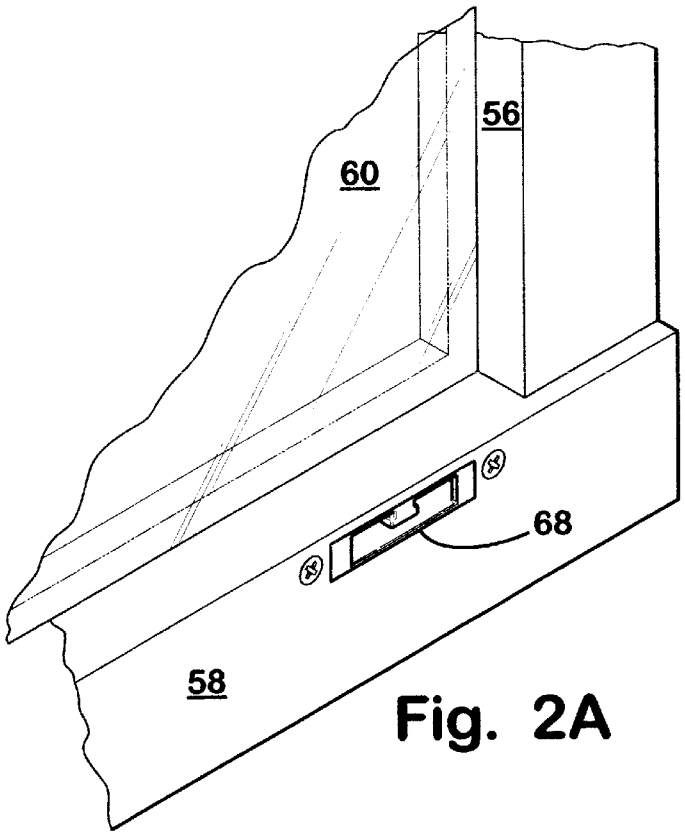
FIG. 2A is a fragmentary perspective view of the upper window sash.
Figure 3:
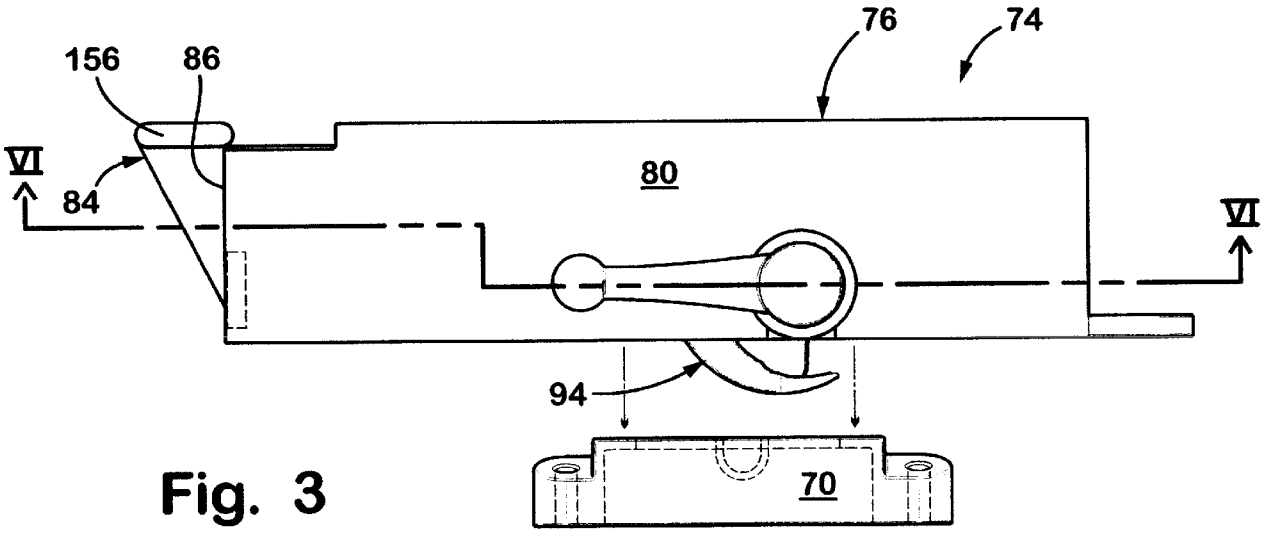
FIG. 3 is a plan view of one embodiment of the tilt latch assembly of this invention.
Figure 4:
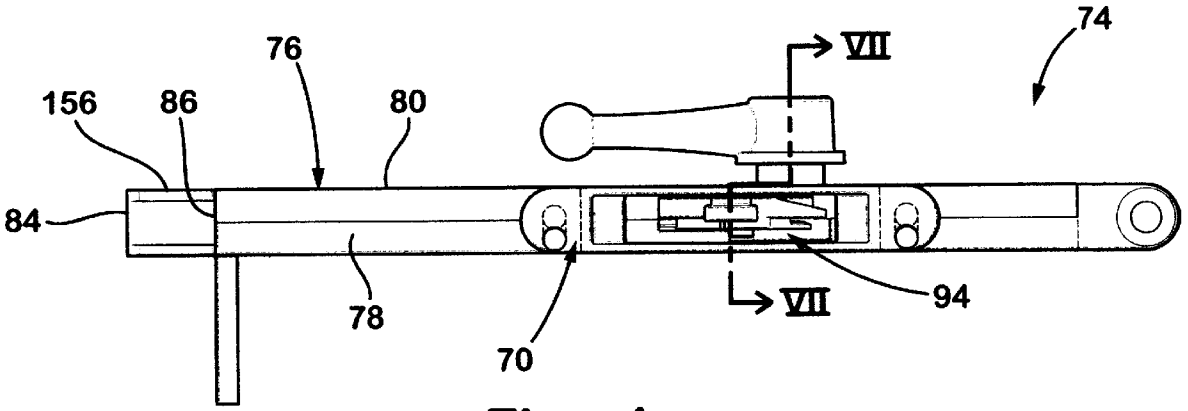
FIG. 4 is an elevation view of the tilt latch assembly shown in FIG. 3.

In operation, it is preferred the keepers 68 and 70 be received in a cavity formed in the vertical interior face of the lower rail 58 of the upper sash 52, similar to that shown in FIG. 2A. The recess for the keepers 68 and 70 may be formed in a variety of ways. For wood window sashes, routing the recess in the lower rail 52 is preferred such that the upper edge is approximately one-quarter to one-eighth of an inch below the upper surface. Alternative positions may also work so long as the keepers mate or are aligned with the sweeper cam 94.

With respect to the housing 76, it is preferred it be mounted in the exterior surface of the upper rail 62 such that housing 76 is concealed along the upper surface by wood of the sash. (See. FIG. 2B). A portion of the sash 64 is cut away identified by numeral 210 to expose the upper end 184 of the shaft 180 and attachment of the lever 120. In this fashion, the downwardly depending flange 114 of the lower housing portion 78 is received within a rabbit groove 212 extending along the exterior of the vertical stiles 56. Likewise, flange 118 is received within the recess formed in the rail to contain the housing 76. In this fashion, both the housing 76 and the keepers 68, 70 are concealed and the user sees only the crank lever 100 which is much more aesthetically appealing than previous locking hardware.

To unlock the lower window sash 54 such that it may be moved upwards and open the window, the operator simply rotates the crank or lever 100 such that cam sweep 190 disengages the keeper. The upper rail of the window sash is retained within a channel formed in the window frame stiles 44,46 by the end 84 of the slide 82. Should the operator desire to tilt the window sash 54 inwardly to clean the glass exterior, the operator simply need only rotate the handle 100 further in the clockwise direction such that the sweep arm 196 engage the rectangular opening 102 to cause the slide 80 to retract within the housing 76, thereby withdrawing the end 84 and tab 156 from the channel in the window frame stile 44,46. This effectively permits the window sash 54 to pivot about the channel follower attached to the lower portion of the window sash. When time to replace the window sash 54 back in the window frame 42, the operator only needs to rotate the lever or crank 100 back to the intermediate position such that the spring 88 urges the slide 82 out of the housing 76. The tapered surface of the slide end 86 permits the user to simply push the window back into the window frame. The slide 82 pops into engagement with the window frame channel, holding the upper end of the window sash 54 in sliding engagement within the window frame.

The above description is considered that of the preferred embodiment only. Modifications of the invention will occur to those skilled in the art and to those who make or use the invention. Therefore, it is understood that the embodiment shown in these drawings and described herein are merely for illustrative purposes and not intended to limit the scope of the invention, which is defined by any claims in a subsequent or related application and interpreted according to the principals of patent law, including the doctrine of equivalence.

We claim as our invention:

1. A window assembly, comprising:

a window frame having two opposing side edges, a top edge and a bottom edge;

an upper and a lower sash frame slidable within said window frame parallel to said two opposing side edges and between said top and bottom edges;

at least one keeper attached to a lower edge of said upper sash frame;

a least one latch assembly attached to an upper edge of said lower sash frame for engaging said at least one keeper, said latch assembly including a slide bia singly urged toward one of said two opposing side edges of said window frame, and having an intermediate opening, and an eccentric sweeper cam pivotally mounted to said upper edge of said lower sash and positioned in said intermediate opening of said slide, said eccentric sweeper cam having at least one edge configured to engage said slide; and a lever attached to said eccentric sweeper cam for rotating said eccentric sweeper cam between a first and a second position such that said at least one edge of said eccentric sweeper cam engages said slide in said intermediate opening to move said slide between a first and second position.

2. The window assembly as defined in claim 1, further comprising a concealment attached to said upper edge of said lower sash frame and over said eccentric sweeper cam and said at least one slide.

3. The window assembly as defined in claim 2, wherein said concealment includes an opening for visually determining a position of said slide relative to said one opposing side edge.

4. The window assembly as defined in claim 1, further comprising a lower housing member attached to said upper edge of said lower sash frame, and having a journal defined therein for receiving an axle member of said eccentric sweeper cam.

5. The window assembly as defined in claim 1, wherein said slide is translatable away from said one opposing sides edges upon rotation of said eccentric sweeper cam to disengage said upper edge of said lower sash frame from said window frame, and permitting said upper edge of said lower sash frame to pivot about a lower axis away from said upper sash frame.

6. A window locking assembly, comprising in combination:

a window frame;

an upper window sash movable within said window frame;

a keeper attached to a lower edge of said upper window sash;

a lower window sash movable within said window frame; and a latch assembly attached to an upper edge of said lower window sash and adapted to engage said keeper attached to said lower edge of said upper window sash, said latch assembly having a slide slidably mounted to said upper edge of said lower window sash for translation between a first position engaging said window frame and a second position away from said window frame, a sweeper cam pivotally coupled to said upper edge of said lower window sash said sweeper cam directly engaging said slide and adapted to urge said slide between said first and second positions upon rotation of said sweeper cam, and a lever attached to said sweeper cam for rotating said sweeper cam between said first and second positions.

7. The window locking assembly as defined in claim 6, further comprising a concealment attached to said upper edge of said lower window sash and enclosing said slide for directing said slide to translate substantially perpendicular to said window frame.

8. The window locking assembly as defined in claim 7, wherein said concealment include journals for rotatably supporting said sweeper cam therein.

9. The window locking assembly as defined in claim 8, wherein said concealment includes a lower portion attached to said upper edge of said lower window sash, and an upper portion covering said slide and said sweeper cam.

10. An assembly for locking the relative positions of a first window sash relative to a second window sash, both in sliding engagement within a window frame, comprising:

a keeper attached to an edge of the first window sash; and a latch assembly attached to an edge of the second window sash such that said keeper and said latch assembly are adjacent each other when the first window sash and the second window sash close the window frame, said latch assembly having a concealment attached to said edge of the second window frame, a translatable slide disposed within said concealment and adapted to engage the window sash when in a first extended position, and a sweeper cam pivotally coupled within said concealment and directly engaging said slide for translating said slide within said concealment in and out of engagement with the window frame, and a lever attached to said sweeper cam for rotating said sweeper cam between a first and a second position.

11. The assembly as defined in claim 10, wherein said keeper includes an opening through which a portion of said sweeper cam extends to fix the first window sash relative to the second window sash.

12. The assembly as defined in claim 10, wherein said sweeper cam is disposed within a recess formed in said slide.

13. The assembly as defined in claim 10, wherein said slide includes an end configured to engage a correspondingly shaped recess in a side of the window frame.

14. A window assembly, comprising in combination:

a window frame having two opposing side members, a top member, and a sill member;

an upper window sash assembly slidably disposed on said two opposing side members between said sill member and said top member, said upper window sash assembly having an inside lower member;

a keeper attached to said inside lower member of said upper window sash assembly;

a lower window sash assembly slidably disposed on said two opposing side members between said sill member and said top member, and offset from said upper window sash assembly, said lower window sash assembly having an inside upper member adapted to lie adjacent said inside lower member of said upper window sash assembly; and a latch assembly attached to said inside upper member of said lower window sash assembly and adapted to engage said keeper on said upper window sash assembly and selectively with one of said two opposing side members of said window frame assembly, said latch assembly having a slide slidably disposed on said inside upper member of said lower window sash assembly proximate one of said two opposing side members of said window frame and selectively engaging one of said two opposing side members of said window frame, and a sweeper cam rotatably disposed intermediate said slide and directly engaging said slide and adapted to urge said slide in and out of engagement with said one of said two opposing side members of said window frame and selectively engage said keeper on said inside lower member of said upper window sash assembly to lock and unlock said lower window sash assembly relative to said upper window sash assembly.

15. The window assembly as defined in claim 14, further comprising a concealment substantially enclosing said slide and said sweeper cam, and providing a journal bearing for said sweeper cam.

16. The window assembly as defined in claim 15, further comprising a view gauge in said concealment for determining whether said slide is engaging said one of said two opposing side members of said window frame.

17. A window assembly, comprising:

a window frame;

an upper and a lower sash frame slidably within said window frame;

at least one keeper attached to a lower edge of said upper sash frame;

at least one latch assembly attached to an upper edge of said lower sash frame for engaging said at least one keeper, said latch assembly including a slide having an intermediate opening urged toward said window frame, and an eccentric sweeper cam pivotally coupled to said upper edge of said lower sash and positioned within said intermediate opening of said slide, said eccentric sweeper cam having at least one edge configured to engage said slide;

a lever attached to said eccentric sweeper cam for rotating said eccentric sweeper cam between a first and a second position such that at least one edge of said eccentric sweeper cam engages said slide and said intermediate opening to move said slide between a first and a second position;

a concealment attached to said upper edge of said lower sash frame and over said eccentric sweeper cam and said at least one slide; and a biasing member for urging said slide into engagement with said one opposing side edge.

18. An assembly for locking the relative positions of a first window sash relative to a second window sash, both in sliding engagement within a window frame, comprising:

a keeper attached to an edge of the first window sash; and a latch assembly attached to an edge of the second window sash such that said keeper and said latch assembly are adjacent each other when the first window sash and the second window sash close the window frame, said latch assembly having a concealment attached to said edge of the second window frame, a translatable slide disposed within said concealment and adapted to engage the window frame when in a first extended position, and a sweeper cam pivotally coupled within said concealment and engaging said slide for translating said slide within said concealment in and out of engagement with the window frame, a lever attached to said sweeper cam for rotating said sweeper cam between a first and a second position, and a spring member disposed between said concealment and said slide for urging said slide toward the window frame.

* * * * *